US006023516A

United States Patent [19]

Rifkind

[11] Patent Number: 6,023,516

[45] Date of Patent: Feb. 8, 2000

[54] GARMENT WITH A VOICE CHIP IN A SEALED CONTAINER

[75] Inventor: Steven Rifkind, Robbinsville, N.J.

[73] Assignee: Bentex Kiddie Corp., New York, N.Y.

[21] Appl. No.: 09/065,869

[22] Filed: Apr. 24, 1998

[51] Int. Cl.[7] ..... H04R 5/00

[52] U.S. Cl. ..... 381/301; 381/388

[58] Field of Search ..... 381/300, 301, 381/385, 386, 388

[56] References Cited

U.S. PATENT DOCUMENTS

| | | | |
|---|---|---|---|
| 4,314,423 | 2/1982 | Lipsitz et al. . | |
| 4,539,700 | 9/1985 | Sato | 381/301 |
| 4,589,134 | 5/1986 | Waldron | 381/301 |
| 4,702,140 | 10/1987 | Goldfarb . | |
| 4,876,724 | 10/1989 | Suzuki | 381/301 |
| 4,991,222 | 2/1991 | Nixdorf . | |
| 5,096,451 | 3/1992 | Smith et al. . | |
| 5,117,403 | 5/1992 | Eberl et al. . | |
| 5,163,447 | 11/1992 | Lyons . | |
| 5,251,326 | 10/1993 | Silverman . | |
| 5,607,336 | 3/1997 | Lebensfeld et al. . | |

OTHER PUBLICATIONS

Frederick's of Hollywood, Catalog, vol. 70, Issue No. 356, Version 0600, 1990, pp. 66 and 68, "Musical Elephant" and "Wedding Surprise".

*Primary Examiner*—Minsun Oh Harvey
*Attorney, Agent, or Firm*—Kenyon & Kenyon

[57] ABSTRACT

A garment comprises a sound chip permanently affixed thereto. The sound chip includes a rigid platform and a speaker coupled to the rigid platform. A control circuit is coupled to the speaker for producing and transmitting to the speaker a stored signal corresponding to a pre-recorded sound pattern to be reproduced by the speaker. The control circuit and the speaker are then surrounded by a water-tight outer casing.

16 Claims, 4 Drawing Sheets

GARMENT WITH A VOICE CHIP IN A SEALED CONTAINER

FIELD OF INVENTION

The present invention relates to voice emitting devices and more particularly relates to a garment with a voice chip in a sealed container permanently affixed thereto.

BACKGROUND OF THE INVENTION

Known electronic chips which play music may now be made small and quite thin. These chips which employ a vibrating transducer ("transducer chips") as the sound emitting device have been placed, for example, in toys and greeting cards and have even been described in U.S. Pat. No. 5,163,447 as mountable in a condom. However, because the transducer plate serving as the sound emitting device in such a chip is not secured to any rigid support, the range of frequencies which can be simultaneously reproduced by these chips is extremely limited. Thus, although these chips can reproduce music, this music is generally characterized by a melody with only a single being played at a time. This limited frequency response makes these chips unsuitable for voice reproduction. Recorded words can be played by these chips but the limited frequency response results in a voice which sounds mechanical or robotic and from which the original speaker's voice is not recognizable.

Known chips capable of more accurately reproducing a human voice ("voice chips"), or other signal requiring an extended frequency range, are much larger than these transducer chips. This larger size is required to accommodate the more advanced speakers and the rigid supporting structure for the speakers of these voice chips.

Such voice chips have been placed in garments, but only in a manner which allows the chips to be removed when the garment is washed. These chips were placed in a pocket when the garment was to be worn and were removed from the pocket when the garment was to be washed. Unfortunately, because these chips are removable for washing, they may also be removed from the garments while in store. Of course, this greatly reduces the value of the product. In addition, the rigid casing of these switches caused a risk of injury to a wearer of a garment—especially when the garments are intended for children.

SUMMARY OF THE INVENTION

The present invention is directed to a garment comprising a sound chip permanently affixed thereto. The sound chip includes a rigid platform and a speaker coupled to the rigid platform. A control circuit is coupled to the speaker for producing and transmitting to the speaker a stored signal corresponding to a pre-recorded sound pattern to be reproduced by the speaker. The control circuit and the speaker are then surrounded by a water-tight outer casing.

DETAILED DESCRIPTION OF THE INVENTION

Figure 1:
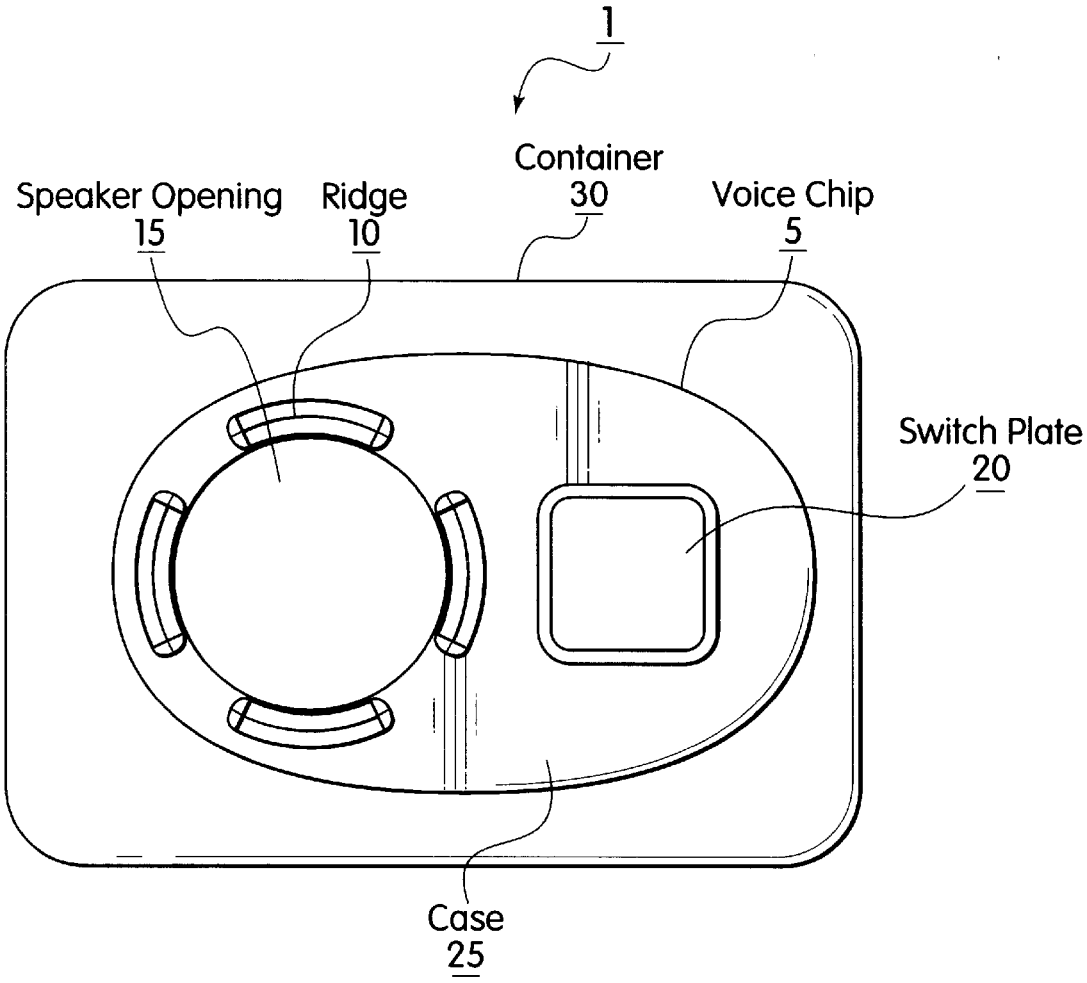
FIG. 1 shows a device according to the present invention.
Figure 2:
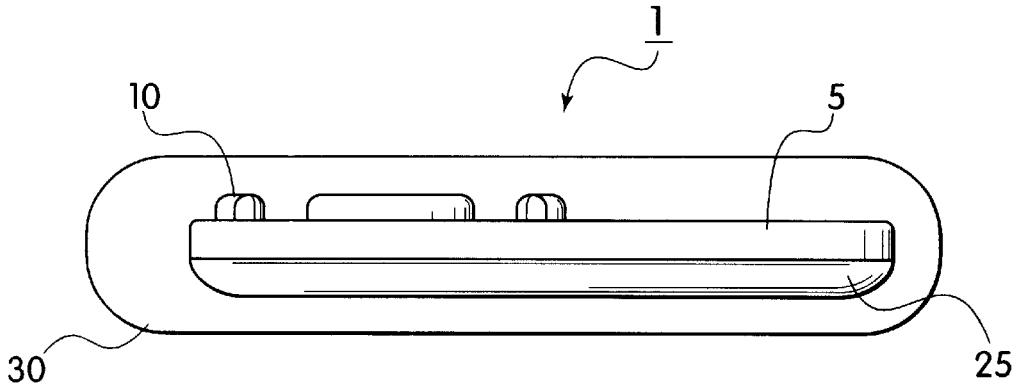
FIG. 2 shows a side view of the device.
Figure 3:
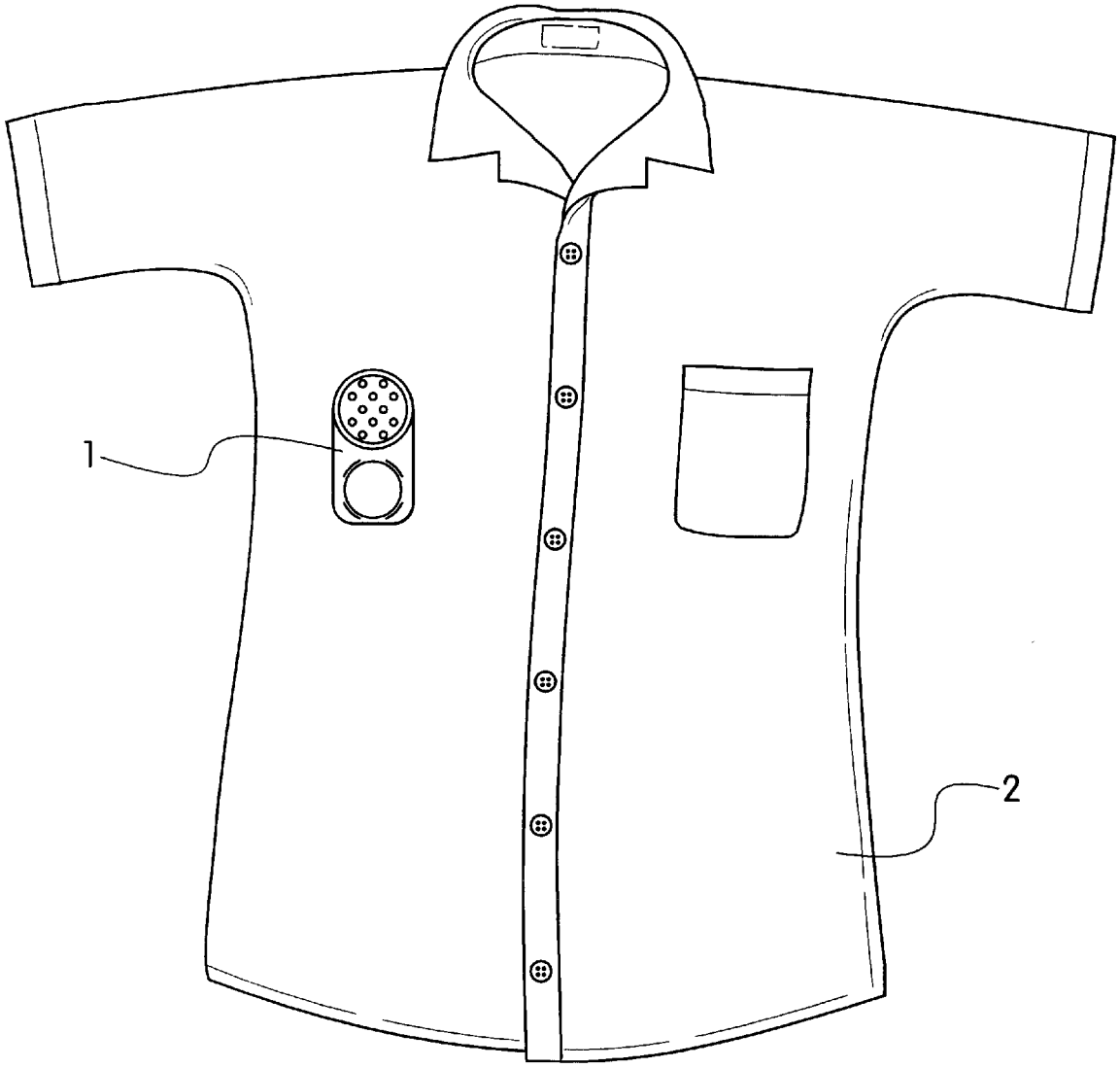
FIG. 3 shows a device according to the present invention embedded in a garment.
Figure 4:
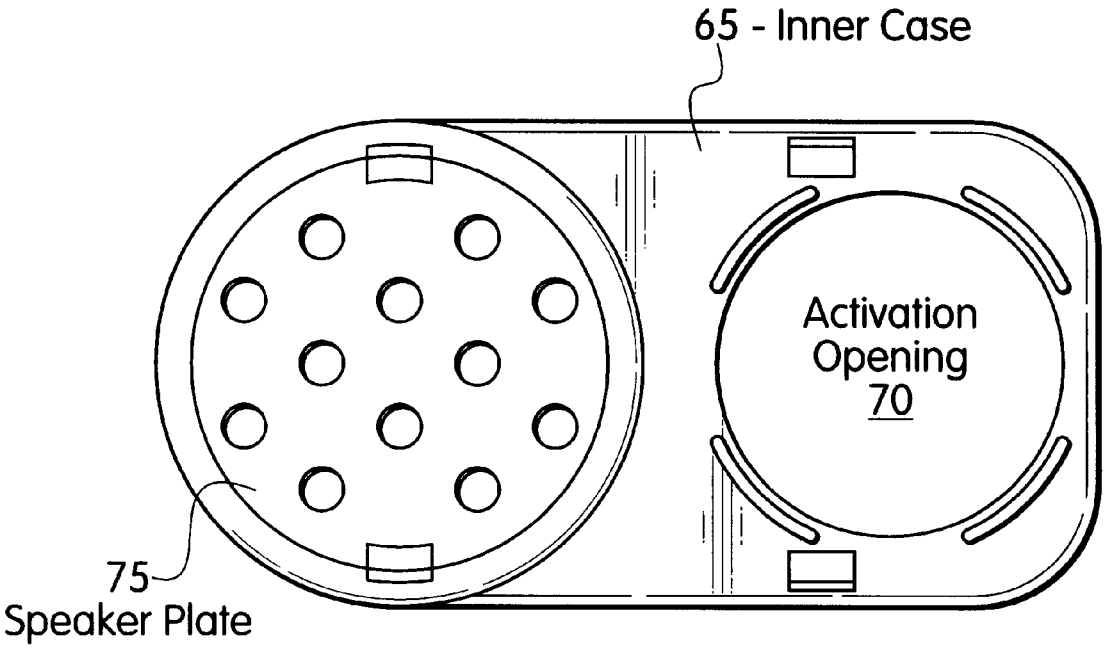
FIG. 4 shows an inner case.

FIGS. 1–4 show a device 1 according to the present invention. The device 1 includes a voice chip 5 and a container 30 which is preferably permanently affixed to a garment 2.

The voice chip 5 has an outer case 25. The case 25 has an oval shape with no sharp edges. Of course, those skilled in the art will understand that the case 25 may be formed in any shape so long as it is sufficiently large to accommodate a sound emitting system 26 (described below). For example the case 25 be rectangular or may be shaped as a disc or a sphere.

The case 25 is preferably made of, for example, a soft material, e.g., a flexible plastic or polymer (i.e., polyvinyl chloride). This flexible material and the rounded shape of the case 25 reduce the potential for injury, for example, when a consumer wearing a garment containing the device 1 falls down. This is especially important when the garment is designed for use by children. However, those skilled in the art will understand that, even when formed of a more rigid material, the chip 25 will otherwise work equally well when permanently embedded in a garment.

In addition, the cases 25 of devices 1 may be formed of different colored material where each color corresponds, for example, to a different voice recording or any other feature of the device 1 which would not otherwise be visually apparent. This simplifies the manufacturing process by allowing workers to more quickly and accurately identify each different chip for placement into corresponding garments.

The case 25 may also be formed with a plurality of ridges 10 extending from an outer surface thereof. For example, as shown in FIG. 1, four ridges are situated around a speaker opening 15. Thus, if these devices 1 are packed one on top of another, the ridges 10 maintain a separation between the devices 1 preventing unwanted activation and saving battery life during storage and shipment of the devices 1.

Figure 5:
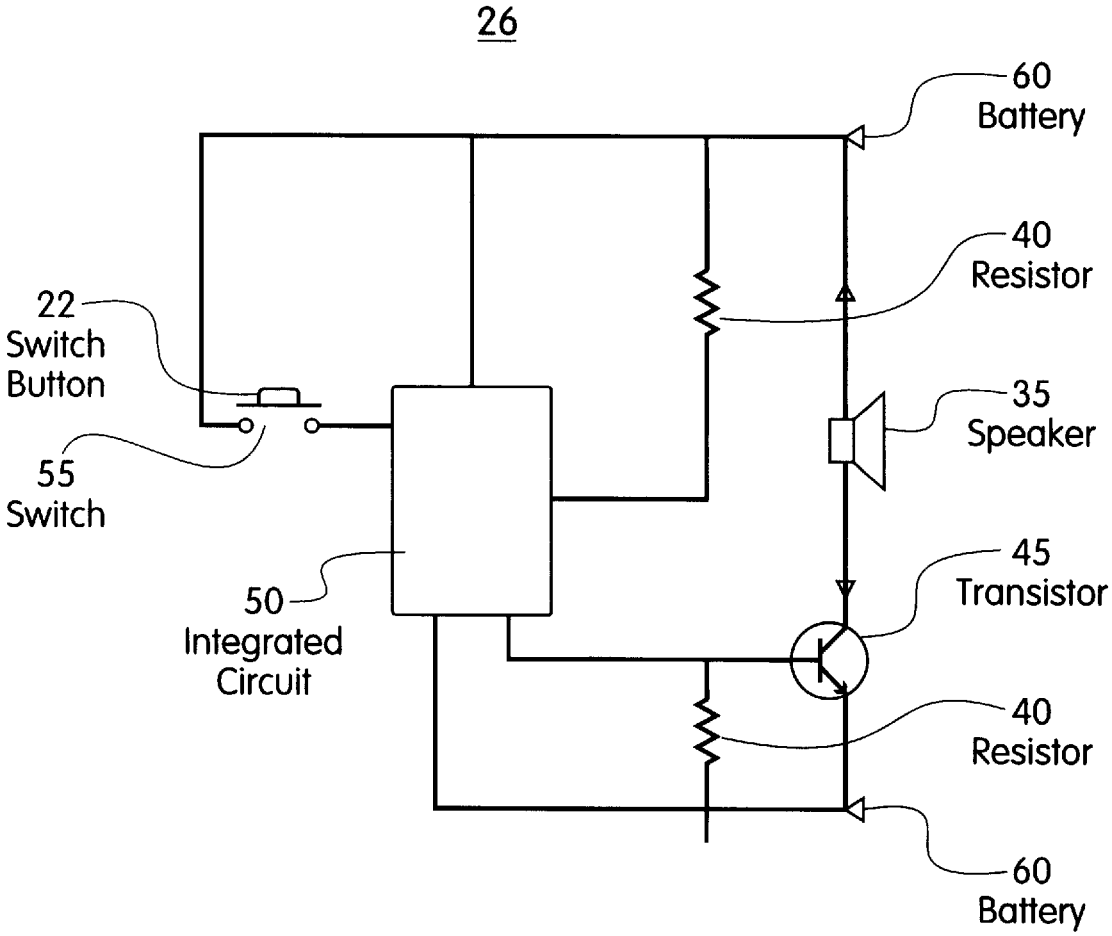
FIG. 5 shows a scheme of a sound emitting system of a voice chip.

In addition, the case 25 has a switch plate 20 formed on the outer surface of the case 25. The switch plate 20 may be formed, for example, as a square or circular portion of the flexible outer surface of the casing 25 located adjacent to a force-sensitive switch button 22 of the sound emitting system 26 which, as shown in FIG. 5, activates and deactivates a switch 55 between a battery 60 and the speaker 35.

Those skilled in the art will understand that the switch plate 20 preferably extends over a surface area much larger than that of the switch button 22, allowing a user to press anywhere on the larger switch plate 20 to activate the smaller switch button 22. Those skilled in the art will understand that this will allow users, particularly children, to more easily activate the voice chip 5. In addition to activation by the switch button 22, the device 1 may include a remote activation system as is known in the art(not shown).

The voice chip 5 also has a rigid inner case 65 (shown in FIG. 3) which is being positioned inside of the outer case 25. The inner case 65 includes a speaker plate 75 and an activation opening 70. Those skilled in the art will understand that, although the speaker plate 75 is shown in this embodiment integrally formed with the inner case 65, the speaker plate 75 may be formed separately from the inner case 65. The speaker plate 75 which includes a plurality of openings for projecting sound out of the case 65, may preferably be formed on a top surface of the inner case 65, wherein the top surface is oriented to face outward in a direction to which the sound from the device 1 is to be projected. The speaker 35 is coupled to an inner surface of the speaker plate 75. The speaker plate 75 is exposed to the outside of the outer case 25 by the speaker opening 15 so that sound from the speaker 35 is projected outward from the device 1 through the speaker plate 75. In addition, a PC board (not shown) to which the sound emitting system 26 of FIG. 5 is attached, is coupled to the inner case 65.

Those skilled in the art will understand that, as with known voice chips, voice chip 5 is capable of reproducing an extended range of frequencies so that a voice recording reproduced by the chip 5 is recognizable as human and the speaker may be identified.

As shown in FIG. 5, the speaker 35 is coupled to at least one battery 60, at least one resistor 40 and a transistor 45. However, the sound emitting system 26 may, for example, include two, three or more batteries 60 and two or more resistors 40. An integrated circuit 50 storing data representative of at least one prerecorded voice message (or other sound) is coupled to the at least one resistor 40 and the switch 55.

When the switch plate 20 is pressed through the activation opening 70, the switch button 22 is depressed closing the switch 55 which activates the sound emitting system 26 and the prerecorded voice is played through the speaker 35. The prerecorded voice can be, for example, a voice easily recognized by children, e.g., Whinny the Pooh.

Alternatively, the voice chip 5 may include a plurality of prerecorded messages stored on the integration circuit 50 with known circuits for randomly playing a particular one of the messages each time the switch plate 20 is pressed or for playing, upon receipt of a predetermined input from a user, a selected one of the messages.

The entire voice chip 5 is sealed in the container 30 (shown in FIGS. 1 and 2) which permanently protects the chip from water. This container 30 may preferably be formed of a flexible plastic and may then be heat sealed. The waterproof container 30 allows the device 1 to be permanently embedded in a garment and subjected to multiple washing without need to remove the device 1. This permanent attachment of the device 1 to a garment also helps to prevent theft of the device 1 from a retail store.

Those skilled in the art will understand that the above-described embodiments are illustrative in nature and are not intended to limit the scope of the invention. There are many variations of the described embodiments which will be apparent to those of skill in the art and these variations are considered to be part of the teaching of this invention which is intended to be limited only by the scope of the claims appended hereto.

What is claimed is:

1. A garment comprising:

a sound chip permanently affixed to the garment, the sound chip including:

a rigid platform;

a speaker coupled to the rigid platform;

a control circuit coupled to the speaker for producing and transmitting to the speaker a stored signal corresponding to a pre-recorded sound pattern to be reproduced by the speaker; and a water-tight outer casing surrounding the control circuit and the speaker.

2. The garment according to claim 1, wherein the outer casing is formed as a flexible plastic pouch surrounding the rigid platform.

3. The garment according to claim 1, wherein the sound chip includes an inner casing extending around the control circuit, the rigid platform and the speaker wherein the inner casing is surrounded by the outer casing.

4. The garment according to claim 1, wherein the sound chip further includes a switch coupled to the control circuit, wherein, when the switch is pressed by a user the control circuit is activated to transmit to the speaker the stored signal.

5. A garment comprising:

a sound chip permanently affixed to the garment, the sound chip including:

a rigid platform;

a speaker coupled to the rigid platform;

a control circuit coupled to the speaker for producing and transmitting to the speaker a stored signal corresponding to a pre-recorded sound pattern to be reproduced by the speaker;

a water-tight outer casing surrounding the control circuit and the speaker;

a switch coupled to the control circuit;

an inner casing extending around the control circuit, the rigid platform and the speaker, the inner casing being surrounded by the outer casing; and a switch plate formed on the inner casing adjacent to the switch, wherein, when the switch is pressed by a user the control circuit is activated to transmit to the speaker the stored signal.

6. The garment according to claim 1, wherein the stored signal is a voice signal.

7. The garment according to claim 5, wherein the control circuit and the inner casing are coupled to the rigid platform and wherein the rigid platform includes a switch hole situated between the switch plate and the switch button.

8. The garment according to claim 5, wherein a surface of the inner casing on which the switch plate is formed includes at least one ridge projecting therefrom.

9. The garment according to claim 5, wherein the inner casing includes a speaker hole extending therethrough so that a portion of the rigid platform to which the speaker is coupled is exposed to an outside of the inner casing.

10. The garment according to claim 9, wherein the include portion of the rigid platform to which the speaker is coupled includes at least one perforation extending therethrough so that the speaker is open to the outside of the inner casing.

11. The garment according to claim 3, wherein a color of one of the inner and outer cases is indicative of a particular pre-recorded sound pattern stored in the control circuit.

12. The garment according to claim 1, wherein the control circuit includes a battery, at least one resistor and an integrated circuit in which data representative of the pre-recorded sound pattern is stored.

13. The garment according to claim 1, wherein edges of an outer surface of the inner casing are rounded.

14. The garment according to claim 7, wherein the portion of the rigid platform to which the speaker is coupled is integrally formed with a portion of the rigid platform to which the control circuit is coupled.

15. The garment according to claim 7, wherein rigid platform is formed of at least two separate portions, the portion of the rigid platform to which the speaker is coupled being formed separately from a portion of the rigid platform to which the control circuit is coupled.

16. The garment according to claim 1, wherein the garment, including the sound chip, is washable.

* * * * *